US007223122B2

(12) United States Patent
Mori

(10) Patent No.: US 7,223,122 B2
(45) Date of Patent: May 29, 2007

(54) ELECTRICAL CONNECTIVITY SYSTEM CAPABLE OF BEING MOUNTED TO AN OBJECT, AND METHOD OF MANUFACTURING SAME

(75) Inventor: Kenneth Mori, Los Angeles, CA (US)

(73) Assignee: Belkin International, Inc., Compton, CA (US)

( * ) Notice: Subject to any disclaimer, the term of this patent is extended or adjusted under 35 U.S.C. 154(b) by 18 days.

(21) Appl. No.: 11/144,406

(22) Filed: Jun. 3, 2005

(65) Prior Publication Data

US 2006/0276077 A1 Dec. 7, 2006

(51) Int. Cl.
*H01R 13/66* (2006.01)

(52) U.S. Cl. ..... 439/574; 439/501

(58) Field of Classification Search ..... 439/501, 439/502, 535, 536–538, 638, 654, 574
See application file for complete search history.

(56) References Cited

U.S. PATENT DOCUMENTS 4,398,647 A * 8/1983 Ackerman ..... 220/3.9
4,944,694 A * 7/1990 Dorn ..... 439/501
6,010,102 A * 1/2000 Dillion, Jr. ..... 248/206.3
7,083,421 B1 * 8/2006 Mori ..... 439/574

* cited by examiner

*Primary Examiner*—X. Chung-Trans
(74) *Attorney, Agent, or Firm*—Bryan Cave LLP

(57) ABSTRACT

An electrical connectivity system capable of being mounted to an object in a variety of configurations includes a housing (110), a power cord (130), and a mounting bracket (120). The housing includes a first threaded aperture (151) at a first surface (111) of the housing, a second threaded aperture at a second surface (112) of the housing, and an electrical connection port (171) at a third surface (113) of the housing. The mounting bracket includes a first portion (121), a second portion (122) adjacent to and extending substantially perpendicularly away from the first portion, and a first aperture (127) in the first portion. The power cord is integral with the housing and is capable of delivering electric power to the electrical connection port.

19 Claims, 6 Drawing Sheets

ELECTRICAL CONNECTIVITY SYSTEM CAPABLE OF BEING MOUNTED TO AN OBJECT, AND METHOD OF MANUFACTURING SAME

FIELD OF THE INVENTION

This invention relates generally to electrical connectivity systems, and relates more particularly to such systems that are capable of being mounted to an object.

BACKGROUND OF THE INVENTION

Electric devices require electric power and/or data signals in order to function, and electrical connectivity systems of many descriptions have been developed for the purpose of delivering such power and data signals. Electrical connectivity systems include wall outlets, power strips, and surge protectors that deliver electric power in the form of alternating current (AC), and further include phone jacks, Ethernet ports, USB and FireWire hubs, and other products containing outlets, jacks, or ports that deliver electric power and/or data required by an electronic device.

Power and data delivery issues often arise at a work area where a computer and computer peripherals are in use. Conveniently positioning an electrical connectivity system capable of such delivery can be a challenge in light of the great variety in the arrangement of furniture, the set-up and placement of equipment, and other factors that have a bearing on the comfort and efficiency of a work area. Most electrical connectivity systems, including most power strips and surge protectors, are designed with the idea that they will simply sit on the floor, or on a work surface next to the computer. At the same time, the relatively few electrical connectivity systems that are mountable tend to be one-dimensional and limited to a single mounting situation, such as being capable only of being mounted flush with a wall. Accordingly, there exists a need for an electrical connectivity system that is capable of being securely mountable in a wide variety of potential mounting situations, and further capable of being move from one such situation to another when such is desired.

BRIEF DESCRIPTION OF THE DRAWINGS

The invention will be better understood from a reading of the following detailed description, taken in conjunction with the accompanying figures in the drawings in which.

Figure 1:
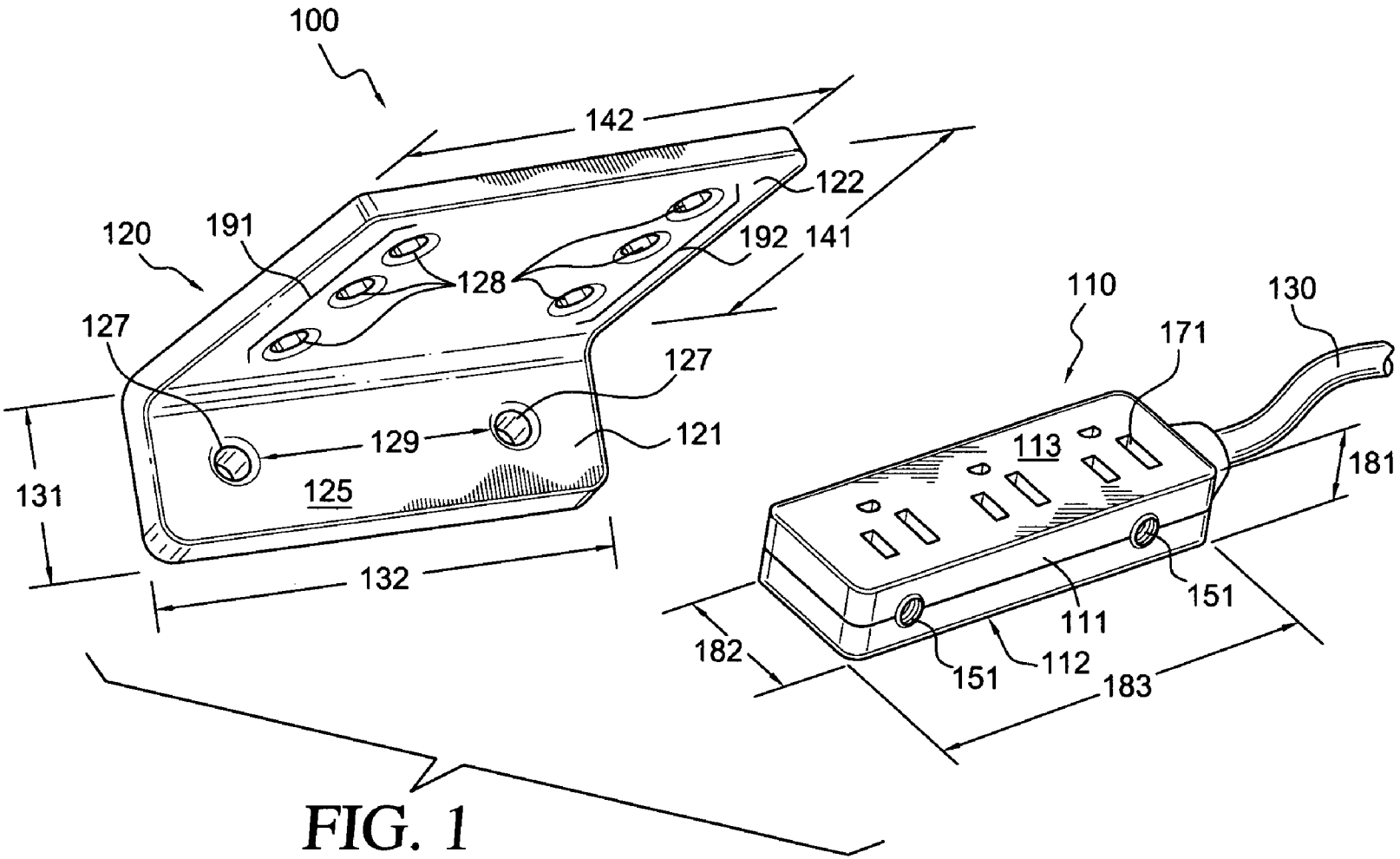
FIG. 1 is a perspective view of an electrical connectivity system—in disassembled form—capable of being mounted to an object according to an embodiment of the invention.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Furthermore, the terms "comprise," "include," "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein. The term "coupled," as used herein, is defined as directly or indirectly connected in an electrical, mechanical, or other manner.

DETAILED DESCRIPTION OF THE DRAWINGS

In one embodiment of the invention, an electrical connectivity system capable of being mounted to an object in a variety of configurations comprises a housing, a power cord, and a mounting bracket. The housing comprises a first threaded aperture at a first surface of the housing, a second threaded aperture at a second surface of the housing, and an electrical connection port at a third surface of the housing. The mounting bracket comprises a first portion, a second portion adjacent to and extending substantially perpendicularly away from the first portion, and a first aperture in the first portion. The power cord is integral with the housing and is capable of delivering electric power to the electrical connection port. As will be explained in detail below, the mounting bracket may be used to mount the housing in a variety of locations, with the electrical connection port oriented in any one of a variety of orientations. The mounting bracket may also receive a variety of accessories, including cord management accessories, useful when used in connection with the housing.

Referring now to the figures, FIG. 1 is a perspective view of an electrical connectivity system 100 capable of being mounted to an object according to an embodiment of the invention. Electrical connectivity system 100 is shown in disassembled form in FIG. 1 so that various components of the system that would otherwise be hidden from view may be shown and described. Electrical connectivity system 100 comprises a housing 110 comprising a surface 111, a surface 112, and a surface 113. In the illustrated embodiment, surfaces 112 and 113 are substantially parallel to each other, and are substantially perpendicular to surface 111.

Threaded apertures 151 are located at surface 111. Additional threaded apertures are located at surface 112, but these additional threaded apertures are not visible in FIG. 1. Any subsequent discussion or description herein of threaded apertures 151 applies equally to the hidden additional threaded apertures, unless otherwise explicitly or contextually indicated.

Although two threaded apertures 151 are at surface 111 in the illustrated embodiment, other embodiments may comprise one, three, or some other number of threaded apertures at surface 111 and at surface 112. In one embodiment, threaded apertures 151 comprise threaded rings made of metal, plastic, or another suitable material around which housing 110 is molded or otherwise formed. Alternatively, the threaded rings may be inserted into housing 110 after its formation, such as by pressing or forcing the threaded rings into the material of housing 110. In another embodiment, threaded apertures 151 are formed during the formation of housing 110, such as by molding threads into the material of housing 110 during an injection molding process.

An electrical connection port 171 is located at surface 113. In the illustrated embodiment, electrical connection port 171 is one of a plurality of electrical connection ports at surface 113. Electrical connection port 171 can be an electrical power outlet, a phone jack, an Ethernet port, a USB or FireWire port, or some other outlet, jack, or port that delivers electric power and/or data required by an electronic device. Each such outlet, jack, or port contains or is associated with circuitry and/or other material that enables, supports, or enhances its functionality. Such circuitry and other associated material, however, is known in the art, and will therefore not be further discussed herein. In a preferred embodiment, electrical connectivity system 100 is a power strip or a surge protector having multiple electrical connection ports delivering AC electric power.

Electrical connectivity system 100 further comprises a power cord 130 integral with housing 110 and capable of delivering electric power to electrical connection port 171. Power cord 130 may be constructed of standard and/or known materials, and it may be connected to housing 110 using standard and/or known techniques. Electrical connectivity system 100 still further comprises a mounting bracket 120 comprising a portion 121 and a portion 122 adjacent to and extending substantially perpendicularly away from portion 121. Portion 121 comprises apertures 127. Portion 122 comprises apertures 128, arranged in a column 191 and an opposite column 192. Apertures 127 and 128 are not necessarily threaded, but may in other ways be similar to threaded apertures 151 in housing 110.

The illustrated embodiment shows two apertures 127 at portion 121. Different embodiments may have one, three, or some other number of apertures in portion 121. As shown, adjacent ones of apertures 127 are separated from each other by a distance 129. In one embodiment, one of apertures 128 from column 191 and a corresponding aperture 128 from column 192 are also separated by distance 129. In the same or another embodiment, adjacent ones of threaded apertures 151 and/or adjacent ones of the additional threaded apertures at surface 112 are also separated by distance 129. With all adjacent apertures separated by a common distance, electrical connectivity system 100 becomes more versatile that it would be otherwise. For example, the multiple connection configurations and mounting scenarios mentioned below are greatly simplified by the fact that a single separation distance is used. The attachment and use of the various accessories to be described below is also simplified by the single separation distance.

In this context, the word "adjacent" is used to refer to two apertures that do not have an aperture between them. The description is less important for the illustrated embodiment, where only two apertures are shown on surface 111 and on surface 125, than for a non-illustrated embodiment where three or more apertures are included at those and/or other surfaces of housing 110 and mounting bracket 120. As an example, two apertures at each surface may be used for a housing having three electrical connection ports, like the one shown in FIG. 1, while three or more apertures at each surface may be used for a housing (not illustrated in FIG. 1) having four, eight, twelve, or some other number of electrical connection ports greater than three.

The dimensions of portions 121 and 122 relative to each other may vary from one to another embodiment of electrical connectivity system 100. In one embodiment, portions 121 and 122 have lengths that are similar to each other, widths that are similar to each other, and thicknesses that are similar to each other. In the illustrated embodiment, portion 121 comprises a dimension 131 and a dimension 132 substantially perpendicular to dimension 131. Portion 122 comprises a dimension 141 and a dimension 142 substantially perpendicular to dimension 141. Housing 110 comprises a dimension 181, a dimension 182 substantially perpendicular to dimension 181, and a dimension 183 substantially perpendicular to dimension 181 and to dimension 182. Dimension 141 is at least twice as large as dimension 131. Dimensions 132 and 142 are substantially equal to each other. Dimensions 181 and 182 are substantially equal to each other and to dimension 131. Dimension 183 is substantially equal to dimensions 132 and 142.

The electrical connectivity system of the illustrated embodiment, having the dimensions just described, may be mounted securely and firmly to a wall, a table, a cabinet, a desk, or the like in a manner to be described immediately below. Further, the described dimensions allow for the mounting of accessories, as will be described below.

Housing 110 and mounting bracket 120 are connected to each other using apertures 127 and either threaded apertures 151 or the additional threaded apertures at surface 112. To use threaded apertures 151, surface 111 of housing 110 and a surface 125 of mounting bracket 120 are brought together such that they are facing each other and threaded apertures 151 are aligned with apertures 127. Surface 112 of housing 110 is positioned adjacent to portion 122 of mounting bracket 120. Fastening devices (not shown in FIG. 1) such as screws or the like are then inserted through apertures 127 and screwed into threaded apertures 151. To use the additional threaded apertures at surface 112, surfaces 125 and 112 are brought together and apertures 127 and the additional threaded apertures are aligned and screws or the like inserted therethrough.

It may be seen that housing 110 and mounting bracket 120 may be connected to each other in other configurations in addition to the two configurations just described. In a first additional connection configuration, surface 111 is adjacent to and facing a surface of portion 121 opposite surface 125. In a second additional connection configuration, surface 112 is adjacent to and facing the surface of portion 121 opposite surface 125. In each connection configuration, the direction in which electrical connection port 171 faces may also be varied according to the circumstances.

Figure 2B:
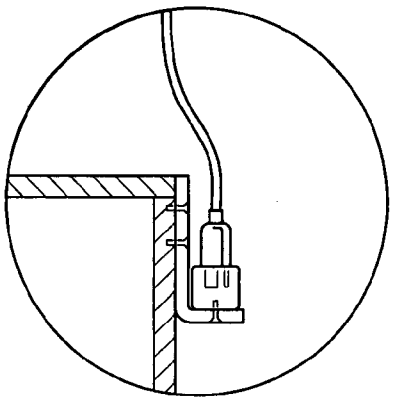
FIGS. 2A–2D are side views of various mounting scenarios for an electrical connectivity system according to an embodiment of the invention.
Figure 2D:
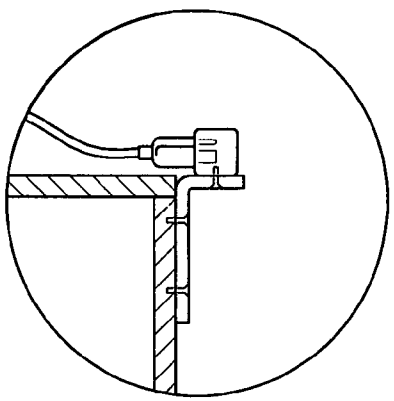
Figure 2A:
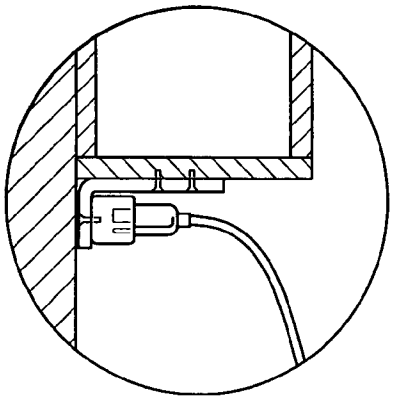
Figure 2C:
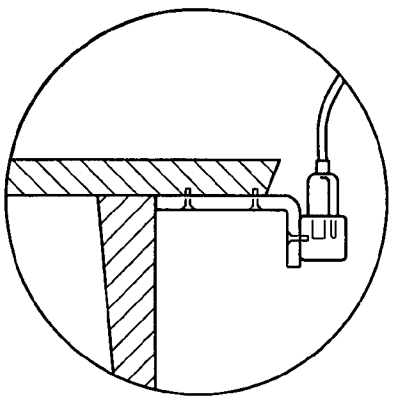

Each connection configuration may be useful for one or more particular mounting scenarios for electrical connectivity system 100. FIGS. 2A–2D depict some such mounting scenarios. FIG. 2A illustrates electrical connectivity system 100 mounted against a wall and under a cabinet or the like. FIG. 2B illustrates electrical connectivity system 100 mounted below the surface of an article of furniture. FIG. 2C illustrates electrical connectivity system 100 mounted to the underside of a table or the like. FIG. 2D illustrates electrical connectivity system 100 mounted above the surface of an article of furniture. Additional mounting scenarios not illustrated herein are also possible. For example, electrical connectivity system 100 may be mounted such that housing 110 is oriented vertically with respect to the floor or ground.

As may be seen, for the mounting scenarios of FIGS. 2A and 2B, surfaces 112 and 125 are mounted adjacent to and facing each other. For the mounting scenario of FIGS. 2C and 2D, it is surfaces 111 and the surface of portion 121 opposite surface 125 that are mounted adjacent to and facing each other.

As an example, housing 110 may be constructed of acrylonitrile butadiene styrene (ABS), polycarbonite, extruded aluminum, sheet metal over plastic, or the like. ABS, for example, is strong, relatively inexpensive, and has pleasing tactile properties. Mounting bracket 120 may be formed from metal, such as cold rolled steel, aluminum, or the like, or it may be formed from a strong plastic material such as ABS, polycarbonite, or the like.

It was mentioned above that mounting bracket 120 may receive a variety of accessories, including cord management accessories, useful when used in connection with housing 110. The accessories are capable of being attached to mounting bracket 120 using at least one of apertures 128. Some, though not all, of the possible accessories will now be discussed, in connection with FIGS. 3–6.

Figure 3:
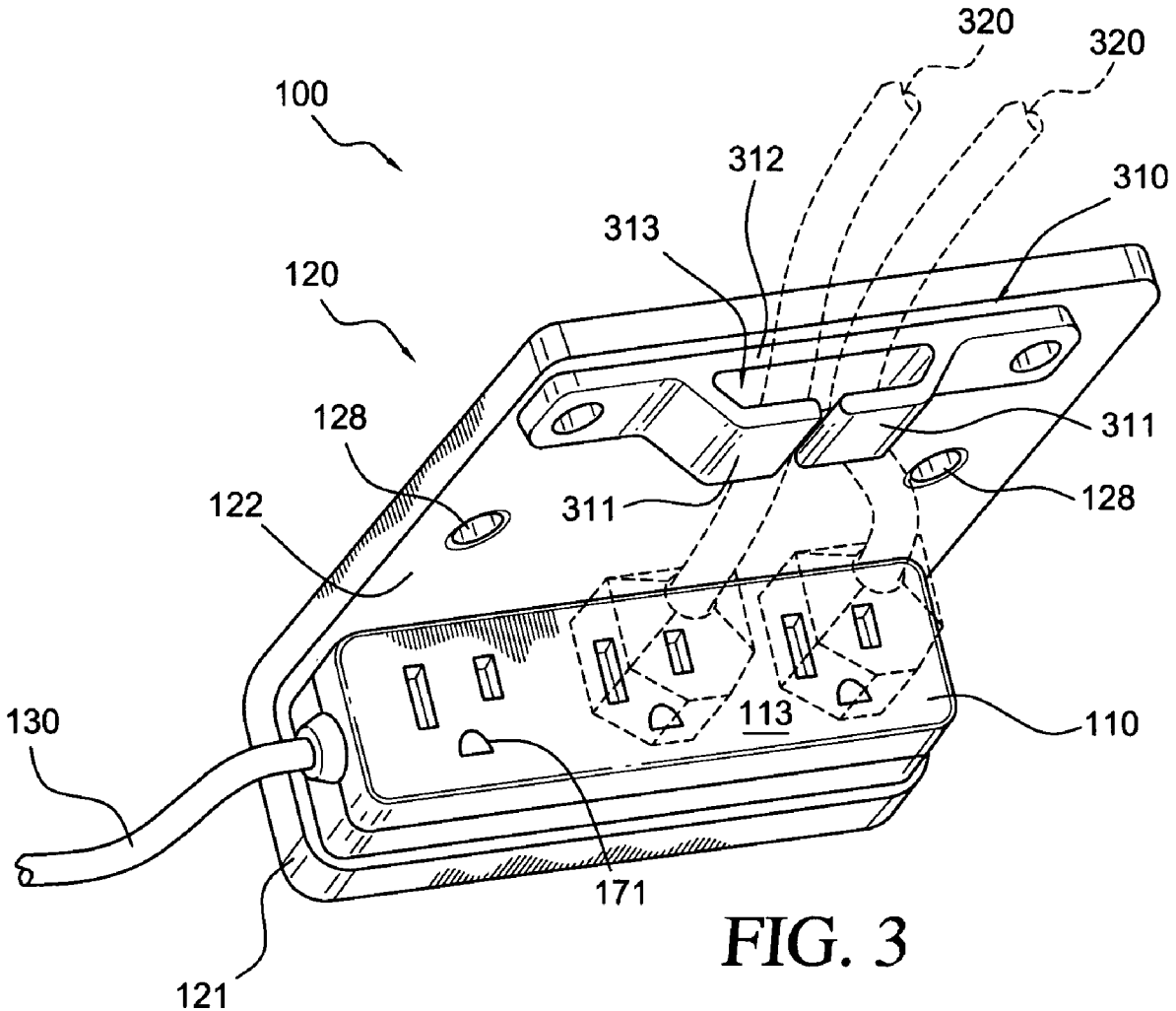
FIG. 3 is a perspective view of an electrical connectivity system having a cord manager bracket connected thereto according to an embodiment of the invention.

FIG. 3 is a perspective view of electrical connectivity system 100 having a cord manager bracket 310 connected thereto according to an embodiment of the invention. As illustrated in FIG. 3, cord manager bracket 310 comprises cord manager arms 311 that extend away from a base 312 to form a cord management aperture 313. Power cords 320, which for clarity are depicted in dotted lines in FIG. 3, extend through cord management aperture 313 and are retained therein by cord manager arms 311. As an example, cord manager arms 311 may be flexed in order to allow the passage of a power cord 320 either into or out of cord management aperture 313. In one embodiment, cord manager bracket 310 is formed of plastic, such as ABS, polyvinyl chloride (PVC), or the like. In another embodiment, cord manager bracket 310 is formed of rubber, such as thermoplastic elastomer (TPE) or the like.

Figure 4:
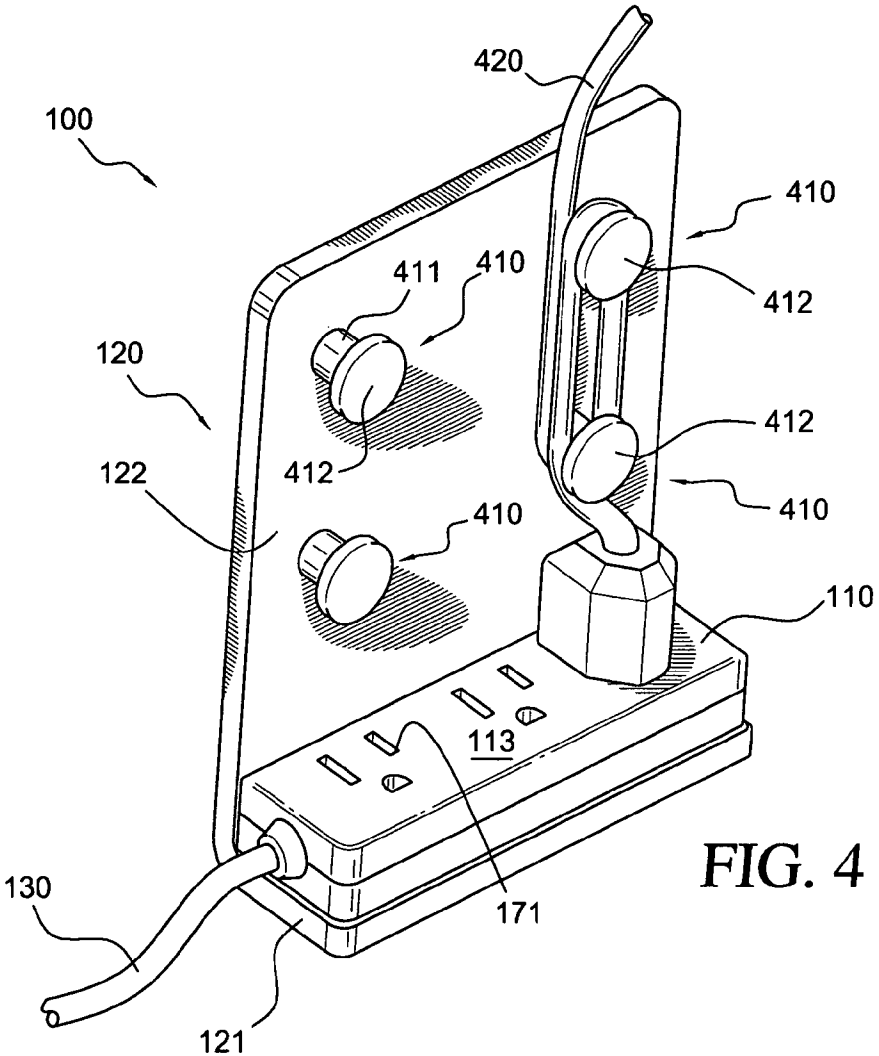
FIG. 4 is a perspective view of an electrical connectivity system having a cord wrap post connected thereto according to an embodiment of the invention.

FIG. 4 is a perspective view of electrical connectivity system 100 having a cord wrap post 410 connected thereto according to an embodiment of the invention. As illustrated in FIG. 4, cord wrap post 410 comprises a post 411 topped with a cap 412. As an example, post 411 can have a threaded and hollow interior so as to receive a screw. As another example, post 411 itself can be threaded, and can screw into aperture 128 (see FIG. 1). As yet another example, post 411 can snap into aperture 128. Cord wrap post 410, as an example, can be formed of the same materials from which cord manager bracket 310 (see FIG. 3) is formed.

As illustrated, a portion of power cord 420 may be wrapped around cord wrap post 410, and caps 412 will retain the portion of power cord 420 in place. In this way, excess cord may be stored neatly where it is less likely to become tangled and/or unsightly than if it were not wrapped as described. Power cord 420 may be wrapped around two cord wrap posts 410, as shown, or wrapped around all four of the cord wrap posts, just three, a different set of two, or some other configuration. In a non-illustrated embodiment, fewer than four cord wrap posts 410 are inserted into apertures 128, and the cord wrap pattern may be adjusted accordingly.

Figure 6:
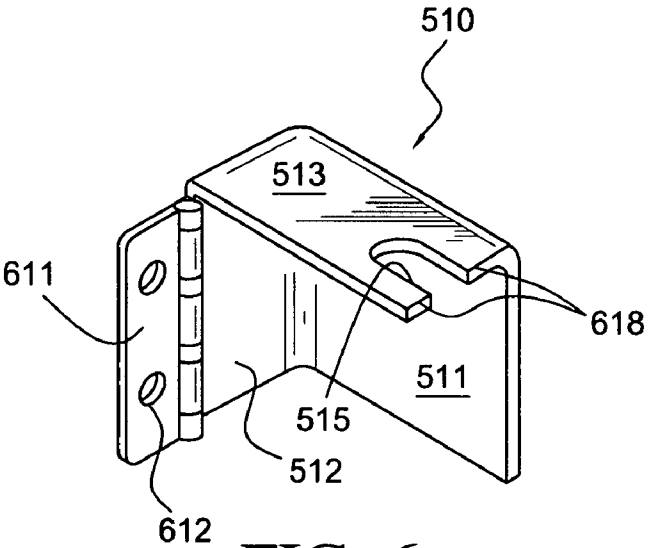
FIG. 6 is a perspective view of the hinged door of FIG. 5 according to an embodiment of the invention.
Figure 5:
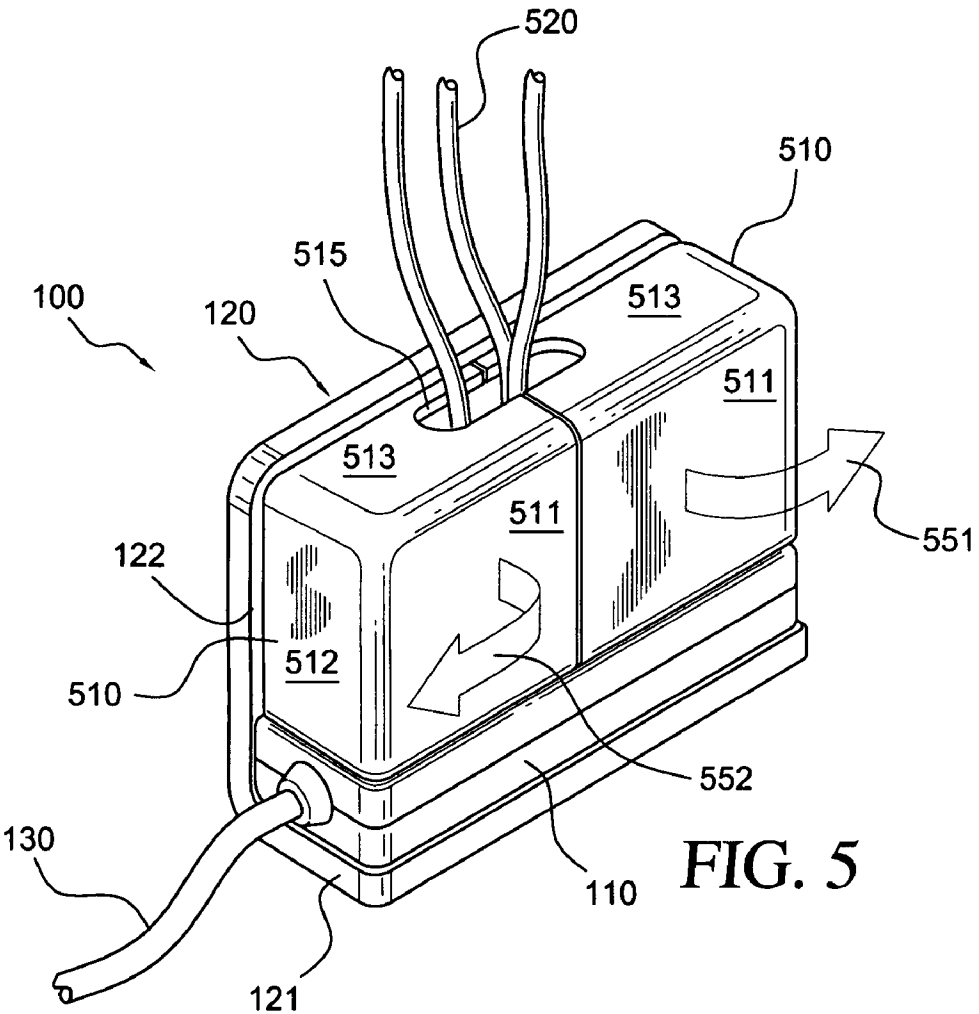
FIG. 5 is a perspective view of an electrical connectivity system having a hinged door connected thereto according to an embodiment of the invention.

FIG. 5 is a perspective view of electrical connectivity system 100 having a hinged door 510 connected thereto according to an embodiment of the invention. FIG. 6 is a perspective view of hinged door 510 according to an embodiment of the invention. As illustrated in FIGS. 5 and 6, hinged door 510 comprises a front panel 511, a side panel 512, and a top panel 513. Side panel 512 is coupled to a hinge 611 which has an aperture 612 therein. Hinge 611 allows hinged door 510 to open as indicated by directional arrows 551 and 552, and close by traveling in an opposing direction.

Aperture 612 may be aligned with aperture 128 (see FIG. 2) and a fastening device such as a screw inserted therethrough in order to attach hinged door 510 to mounting bracket 120. In a different embodiment, hinged door 510 may be provided with pegs or the like suitable for being snapped into place in apertures 128.

Top panel 513 comprises arms 618 that define a cord management aperture 515 in top panel 513. Power cords 520 may be maintained in place by cord management aperture 515, as shown. As an example, power cords 520 may be positioned as shown in FIG. 5, and hinged doors 510 may then be closed around power cords 520. The result is that power cords 520 are neatly constrained to lie in the same general direction and space, while the plugs (not shown) at the end of power cords 520 are hidden from view. Hinged door 510, as an example, can be formed of the same materials from which cord manager bracket 310 (see FIG. 3) is formed. Hinge 611 may be formed of metal or the like according to industry standards.

In a non-illustrated embodiment, top panel 513 does not have arms 618 and does not define cord management aperture 515. Instead, in that non-illustrated embodiment, hinged door 510 with a continuous top panel 513 is attached to mounting bracket 120 as described and, when closed, obscures from view the power plugs as well as cord manager bracket 310 (see FIG. 3) or the like that performs the same function that arms 618 and cord management aperture 515 perform in the illustrated embodiment.

Figure 7:
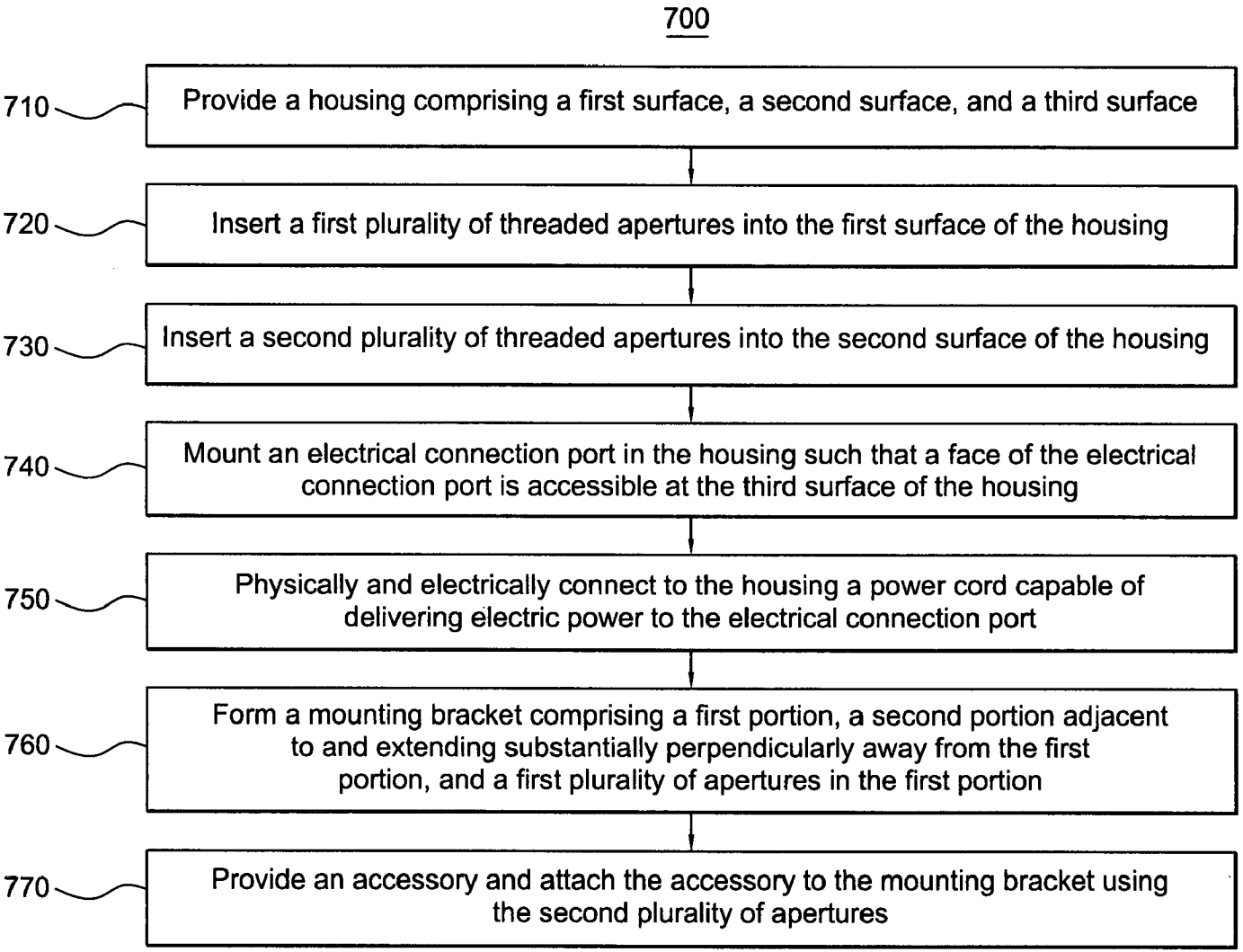
FIG. 7 is a flowchart illustrating a method of manufacturing an electrical connectivity system capable of being mounted to an object according to an embodiment of the invention.

FIG. 7 is a flowchart illustrating a method 700 of manufacturing an electrical connectivity system capable of being mounted to an object according to an embodiment of the invention. A step 710 of method 700 is to provide a housing comprising a first surface, a second surface, and a third surface. As an example, the housing, the first surface, the second surface, and the third surface can be similar to, respectively, housing 110, surface 111, surface 112, and surface 113, all of which were first shown in FIG. 1.

A step 720 of method 700 is to insert a first plurality of threaded apertures into the first surface of the housing. As an example, each one of the first plurality of threaded apertures can be similar to threaded aperture 151, first shown in FIG. 1. In one embodiment, step 720 comprises molding the housing around the threaded aperture. In another embodiment, step 720 comprises inserting the threaded aperture into the housing after the formation of the housing, such as by pressing or forcing the threaded rings into the material of the housing. In yet another embodiment, step 720 comprises forming the threaded apertures are formed during the formation of the housing, such as by molding threads into the material of the housing during an injection molding process or the like. In a particular embodiment, step 720 comprises forming adjacent ones of the threaded apertures to be separated by a distance such as distance 129, first discussed in connection with FIG. 1.

A step 730 of method 700 is to insert a second plurality of threaded apertures into the second surface of the housing. As an example, each one of the second plurality of threaded apertures can also be similar to threaded aperture 151. In one embodiment, step 730 comprises forming adjacent ones of the threaded apertures to be separated by the same distance that separates adjacent ones of the first plurality of threaded apertures. In the same or another embodiment, steps 730 and 720 are performed simultaneously with each other.

A step 740 of method 700 is to mount an electrical connection port in the housing such that a face of the electrical connection port is accessible at the third surface of the housing. As an example, the electrical connection port can be similar to electrical connection port 171, first shown in FIG. 1.

A step 750 of method 700 is to physically and electrically connect to the housing a power cord capable of delivering electric power to the electrical connection port. As an example, the power cord can be similar to power cord 130, first shown in FIG. 1.

A step 760 of method 700 is to form a mounting bracket comprising a first portion, a second portion adjacent to and extending substantially perpendicularly away from the first portion, and a first plurality of apertures in the first portion. As an example, the mounting bracket, the first portion, and the second portion can be similar to, respectively, mounting bracket 120, portion 1212, and portion 122, all of which were first shown in FIG. 1. As another example, each one of the first plurality of apertures can be similar to apertures 127, which were also first shown in FIG. 1.

In one embodiment, step 760 comprises forming the mounting bracket such that adjacent ones of the first plurality of apertures are separated by the same distance that separates adjacent ones of the first plurality of threaded apertures. In the same or another embodiment, step 760 or another step comprises forming the mounting bracket to have a second plurality of apertures in the second portion. As an example, each one of the second plurality of apertures can be similar to apertures 128, first shown in FIG. 1. In a particular embodiment, step 760 or the other step comprises forming the mounting bracket such that adjacent ones of the second plurality of apertures are separated by the same distance that separates adjacent ones of the first plurality of threaded apertures.

A step 770 of method 700 is to provide an accessory and attach the accessory to the mounting bracket using the second plurality of apertures. As an example, the accessory can be similar to cord manager bracket 310, first shown in FIG. 3. As another example, the accessory can be similar to cord wrap post 410, first shown in FIG. 4. As still another example, the accessory can be similar to hinged door 510, first shown in FIG. 5.

Although the invention has been described with reference to specific embodiments, it will be understood by those skilled in the art that various changes may be made without departing from the spirit or scope of the invention. Various examples of such changes have been given in the foregoing description. Accordingly, the disclosure of embodiments of the invention is intended to be illustrative of the scope of the invention and is not intended to be limiting. It is intended that the scope of the invention shall be limited only to the extent required by the appended claims. For example, to one of ordinary skill in the art, it will be readily apparent that the electrical connectivity system discussed herein may be implemented in a variety of embodiments, and that the foregoing discussion of certain of these embodiments does not necessarily represent a complete description of all possible embodiments. Rather, the detailed description of the drawings, and the drawings themselves, disclose at least one preferred embodiment of the invention, and may disclose alternative embodiments of the invention.

All elements claimed in any particular claim are essential to the invention claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. An electrical connectivity system capable of being mounted to an object, the electrical connectivity system comprising:

a housing comprising:
- a first threaded aperture at a first surface of the housing;
- a second threaded aperture at a second surface of the housing;
- an electrical connection port at a third surface of the housing; and
- a power cord integral with the housing and capable of delivering electric power to the electrical connection port; and a mounting bracket comprising:
- a first portion;
- a second portion adjacent to and extending substantially perpendicularly away from the first portion; and
- a first aperture in the first portion;

wherein the first portion comprises:
- a first dimension; and
- a second dimension substantially perpendicular to the first dimension;

wherein the second portion comprises
- a third dimension; and
- a fourth dimension substantially perpendicular to the third dimension; and
- the third dimension is at least twice as large as the first dimension; and wherein the housing comprises:
- a fifth dimension;
- a sixth dimension substantially perpendicular to the fifth dimension; and
- a seventh dimension substantially perpendicular to the fifth dimension and to the sixth dimension;
- the second dimension and the fourth dimension are substantially equal to each other;
- the fifth and sixth dimensions are substantially equal to each other and to the first dimension; and the seventh dimension is substantially equal to the second and fourth dimensions.

2. The electrical connectivity system of claim 1 wherein:

the first portion comprises a first plurality of apertures, including the first aperture; and the second portion comprises a second plurality of apertures.

3. The electrical connectivity system of claim 2 further comprising:

an accessory capable of being attached to the mounting bracket using at least one of the second plurality of apertures.

4. The electrical connectivity system of claim 3 wherein:

the accessory is a hinged door.

5. The electrical connectivity system of claim 3 wherein:

the accessory is a cord wrap post.

6. The electrical connectivity system of claim 3 wherein:

the accessory is a cord manager bracket.

7. An electrical connectivity system capable of being mounted to an object, the electrical connectivity system comprising:

a housing comprising:

a first threaded aperture at a first surface of the housing;

a second threaded aperture at a second surface of the housing;

an electrical connection port at a third surface of the housing; and a power cord integral with the housing and capable of delivering electric power to the electrical connection port; and a mounting bracket comprising:

a first portion;

a second portion adjacent to and extending substantially perpendicularly away from the first portion; and a first aperture in the first portion;

wherein the first portion comprises:

a first dimension, and a second dimension substantially perpendicular to the first dimension;

wherein the second portion comprises a third dimension; and a fourth dimension substantially perpendicular to the third dimension; and the third dimension is at least twice as large as the first dimension; and wherein the housing further comprises:

a first plurality of threaded apertures, including the first threaded aperture, at the first surface of the housing;

a second plurality of threaded apertures, including the second threaded aperture, at the second surface of the housing;

wherein the mounting bracket further comprises:

a first plurality of apertures, including the first aperture, at the first portion; and a second plurality of apertures at the second portion;

wherein each one of the first plurality of threaded apertures is separated from an adjacent one of the first plurality of threaded apertures by a separation distance;

wherein each one of the second plurality of threaded apertures is separated from an adjacent one of the second plurality of threaded apertures by the separation distance;

wherein each one of the first plurality of apertures is separated from an adjacent one of the first plurality of apertures by the separation distance; and wherein each one of the second plurality of threaded apertures is separated from an adjacent one of the second plurality of threaded apertures by the separation distance.

8. The electrical connectivity system of claim 7:

wherein the first portion comprises:

a first dimension; and a second dimension substantially perpendicular to the first dimension;

wherein the second Portion comprises a third dimension; and a fourth dimension substantially perpendicular to the third dimension; and wherein the third dimension is at least twice as large as the first dimension.

9. The electrical connectivity system of claim 8 wherein the housing further comprises:

a fifth dimension;

a sixth dimension substantially perpendicular to the fifth dimension; and a seventh dimension substantially perpendicular to the fifth dimension and to the sixth dimension;

wherein the second dimension and the fourth dimension are substantially equal to each other;

wherein the fifth and sixth dimensions are substantially equal to each other and to the first dimension; and wherein the seventh dimension is substantially equal to the second and fourth dimensions.

10. The electrical connectivity system of claim 7 further comprising an accessory capable of being attached to the mounting bracket using at least one of the second plurality of apertures.

11. The electrical connectivity system of claim 10 wherein the accessory is a hinged door.

12. The electrical connectivity system of claim 10 wherein the accessory is a cord wrap post.

13. The electrical connectivity system of claim 10 wherein the accessory is a cord manager bracket.

14. An electrical connectivity system capable of being mounted to an object, the electrical connectivity system comprising:

a housing comprising:

a first plurality of threaded apertures at a first surface of the housing;

a second plurality of threaded apertures at a second surface of the housing;

a plurality of electrical power outlets at a third surface of the housing; and a power cord integral with the housing and capable of delivering electric power to the plurality of electrical power outlets; and a mounting bracket comprising:

a first portion;

a second portion adjacent to and extending substantially perpendicularly away from the first portion;

a first plurality of apertures in the first portion; and a second plurality of apertures in the second portion;

wherein the first portion comprises a first dimension and a second dimension perpendicular to the first dimension; and wherein the second portion comprises a third dimension; and a fourth dimension perpendicular to the third dimension;

wherein the housing comprises a fifth dimension, a sixth dimension substantially perpendicular to the fifth dimension, and a seventh dimension substantially perpendicular to the fifth dimension and to the sixth dimension;

wherein the third dimension is at least twice as large as the first dimension and no greater than five times as large as the first dimension;

wherein the second dimension and the fourth dimension are substantially equal to each other;

wherein the fifth and sixth dimensions are substantially equal to each other and to first dimension; and wherein the seventh dimension is substantially equal to the second and fourth dimensions.

15. The electrical connectivity system of claim 14 wherein:

each one of the first plurality of threaded apertures is separated from an adjacent one of the first plurality of threaded apertures by a separation distance;

each one of the second plurality of threaded apertures is separated from an adjacent one of the second plurality of threaded apertures by the separation distance;

each one of the first plurality of apertures is separated from an adjacent one of the first plurality of apertures by the separation distance; and each one of the second plurality of threaded apertures is separated from an adjacent one of the second plurality of threaded apertures by the separation distance.

16. The electrical connectivity system of claim 14 further comprising:

an accessory capable of being attached to the mounting bracket using at least one of the second plurality of apertures.

17. The electrical connectivity system of claim 16 wherein: the accessory is a hinged door.

18. The electrical connectivity system of claim 16 wherein: the accessory is a cord wrap post.

19. The electrical connectivity system of claim 16 wherein: the accessory is a cord manager bracket.

* * * * *